US005800655A

United States Patent [19]

Tokuchi

[11] Patent Number: 5,800,655

[45] Date of Patent: Sep. 1, 1998

[54] METHOD OF TRANSFERRING COLOR COPY

[76] Inventor: Yasuhiko Tokuchi, 707, 1-go,12-ba, Nishioike 2-chome, Kitaku, Kobe-shi, Hyogo-ken, Japan

[21] Appl. No.: 623,686

[22] Filed: Mar. 29, 1996

[30] Foreign Application Priority Data

May 22, 1995 [JP] Japan ..... 7-159736

[51] Int. Cl.[6] ..... B44C 1/16; G03G 15/16

[52] U.S. Cl. ..... 156/230; 156/240; 156/281; 156/289; 399/296; 430/126

[58] Field of Search ..... 156/230, 239, 156/240, 277, 281, 289; 399/147, 296, 302; 430/126; 427/146, 147

[56] References Cited

U.S. PATENT DOCUMENTS 5,459,008 10/1995 Chambers et al. ..... 399/296 X
5,483,321 1/1996 Cahill et al. ..... 156/240 X

FOREIGN PATENT DOCUMENTS 0 708 377 4/1996 European Pat. Off. .
0 747 774 12/1996 European Pat. Off. .
8-146785 6/1996 Japan .
8-310105 11/1996 Japan .

*Primary Examiner*—Curtis Mayes
*Attorney, Agent, or Firm*—Edwin E. Greigg; Ronald E. Greigg

[57] ABSTRACT

Copying a desired image on a separable sheet having a silicone layer by means of a color copy machine of toner type, removing the parts of the silicone layer on the separable sheet which are not covered by the image and coating a toner treating compound on the whole surface of the separable sheet including the surface of the image, overlapping the separable sheet on an object, and then pressing the reverse side of the separable sheet to transfer the color copy. One toner treating compound is prepared by at least a solvent including toluene and ethyl acetate and a solid content including at least epoxy resin or butyrated resin.

6 Claims, 4 Drawing Sheets

METHOD OF TRANSFERRING COLOR COPY

BACKGROUND OF THE INVENTION (1) Field of the Invention

The prevent invention relates to a method of transferring a color copy, a toner treating compound and a transfer sheet for a color copy, and more particularly to the method of transferring a color copy, the toner treating compound and the transfer sheet for a color copy, which are used for a color copy system of toner type among three types, namely, a toner type, a sublimation dyes type, and an ink-jet type.

(2) Prior Art

The color copy system of the toner type is so constructed that fine toner powders of three primary colors, which are made of thermoplastic resin such as epoxy resin, are mixed at a predetermined mixing ratio and set onto an image, so as to make a copy.

The technique of such a color copy is very unique in that the original image can be reproduced on another sheet, but the image can be reproduced only onto a special copy sheet, which is limited in size and material in order to set in a color copy machine.

Recently, in view of superior function in reproduction of the original color image, it is required to transfer the reproduction onto a desired sheet or material including clothes and solid bodies.

An object of the invention is to transfer a color copy onto another material.

As such a transfer technique of color copy, it has been tried to use such a method that the copy surface of the color copy sheet is fit to the object and heat and pressure applied thereon since the color copy machine of toner type uses powders of thermoplastic resin.

However, the color image reproduced on the ordinary copy sheet according to the above-mentioned method has a problem in that the color image cannot be transferred onto the object since the toner image is not easily removed from the copy sheet. Then, lately, a separable sheet having a parting agent (such as normally silicone resin) on the surface thereof has been tried. Namely, the separable sheet is made of a special paper or a plastic sheet (having thermal resistance), and the toner image is set on a separable layer of the separable sheet and by means of a color copy machine, the image is then transferred to the object.

The inventor, however, faced a problem after repetition of the transfer. In using the above-mentioned separable sheet, the toner image was left on the separable sheet partially though it could be carried out to almost transfer the toner image onto the subject material in a manner of heat and pressure or a simple manner of pressure (while rubbing). Therefore, the inventor took a method of increasing a separable force by thickening the separable layer, but a problem occurred in that the toner image could not be fixed on the separable sheet in the process of the color copy machine.

Contrary to this, the inventor tried to take a method of increasing a pressure or a temperature at the time of transfer while keeping the thickness of the separable layer as it was (separable with a small force ). However, in increasing the temperature at the time of transfer, the separable sheet became deformed, or the color toner image of thermoplastic resin got out of shape or the edges of the image became vague. Further, it was found that even when the pressure went up, it was difficult to carry out a complete transfer.

Namely, strongness or weakness of the separable force of the separable sheet was inconsistent with fixing of the toner image and separation of the toner image at the time of transfer.

SUMMARY OF THE INVENTION

An object of the present invention is to provide a method of transferring a color copy, a toner treating compound therefor and a transfer sheet for a color copy, which may transfer a color image finely at the time of transfer, while certainly fixing the image of a color toner onto a transferable sheet in the process of a color copy machine.

In order to achieve the above object, the first method of transferring a color copy according to the present invention comprises the steps of copying a desired image, by means of a color copy machine, onto a separable sheet having a separable layer of silicone, coating a toner treating compound onto the whole surface of the separable sheet including the image, said toner treating compound being prepared by at least a solvent consisting of at least toluene and ethyl acetate and a solid content consisting of at least epoxy resin or butyrated resin, and transferring the image by fitting the surface of the image of the separable sheet to an object and pressing the reverse surface of the separable sheet.

The second method of transferrring a color copy according to the present invention comprises the steps of copying a desired image, by means of a color copy machine, onto a separable sheet having a separable layer of silicone, coating a toner treating compound onto the whole surface of the separable sheet including the image, said toner treating compound being prepared by at least a solvent consisting of at least toluene and methyl-ethyl-ketone and a solid content consisting of at least urethane resin, and transferring the image by fitting the surface of image of the separable sheet to an object and pressing the reverse surface of the separable sheet.

The third method of transferrring a color copy according to the present invention comprises the steps of copying a desired image, by means of a color copy machine, onto a separable sheet having a separable layer of silicone, coating a toner treating compound onto the whole surface of the separable sheet including the image, said toner treating compound being prepared by at least a solvent consisting of at least isopropyl alcohol and toluene and a solid content consisting of at least polyamide resin, and transferring the image by fitting the surface of the image of the separable sheet to an object and pressing the reverse surface of the separable sheet.

According to the present invention, it is preferable to take a step of cleaning the whole surface of the separable sheet with a silicone removing agent prepared by a solvent of petroleum and a surface-active agent so as to remove a silicone coat left as the separable layer on the separable sheet except that covered by the image.

According to the present invention, it is also preferable to coat an adhesive agent on the separable sheet after coating the toner treating compound on the separable sheet.

To achieve the above object, the toner treating compound of the present invention, which is used in a method of transfer of a color copy for copying a desired color image onto a separable sheet by means of a color copy machine and transferring the color image to an object, comprises a toner treating component A and a toner treating component B; said toner treating compound mixing the toner treating component A of 20%~40% with the toner treating component B of 60%~80%, said toner treating component A being prepared by a solvent including toluene of 42%±5%, methyl ketone of 15%±5%, and isopropyl alcohol of 15%±5%, and a solid content including urethane resin of 28%±3%, and said toner treating component B being prepared by a solvent including toluene of 40%±5%, ethyl acetate of 15%±5%, and isopropyl alcohol of 20%±5%, and a solid content including epoxy resin of 7%±3%, butyrated resin of 13%±3% and cellulose nitrate resin of 5%±3%.

In the present invention, it is preferable to include an ultraviolet ray absorbing agent of 1%~5% to the toner treating compound.

According to the method and the toner treating compound of the present invention, which compound comprises a solvent including at least toluene and ethyl acetate and a solid content including at least epoxy resin or butyral resin, or a solvent including at least toluene and methyl-ethyl-ketone and a solid content including urethane resin, or a solvent including isoprophyl alcohol and toluene and a solid content including polyamide resin, the following function is brought forth.

Namely, a peeling force is given at the time of transfer, the color image is not broken partially and left on the separable sheet. This is surmised as follows. When transferring a color copy, the color toner (normally epoxy resin) is partially solved by coating the toner treating compound on the copied image of the transferable sheet and a binding force between the fine particles of the color toner can be increased by the resin of the solid content, so as to form a uniform color image like a film.

As to the function of the toner treating compound, it is not clear how the solvent reacts to the color toner or how the solid content produces such a binding force on the basis of chemical reaction or its own binding characteristics. However, as the result, it may eliminate such a state that the color image is partially broken and left on the separable sheet as a peeling force is given at the time of transfer.

The toner treating compound is a liquid including a component of resin and it is superior in compatibility to the resin of the color toner and provides adhesiveness as its own characteristics. Therefore, it may easily transfer the color image to an object by coating the toner treating compound to the color image and the transferred image surface has a good durability after transfer since the image includes such a resin conponent.

Further, the color image treated by the toner treating compound is very flexible and therefore it becomes possible to smoothly transfer the image onto not only a plane surface but also a curved surface convex or concave.

As the result, the present invention brings the following advantages.

According to the present invention, it may produce a remarkable advantage of carrying out a smooth and fine transfer without patches or pin holes by eliminating a problem that the toner image is partially broken at the time of transfer and left on the separable sheet partially while fixing the color toner image onto the separable sheet in the process of a color copy machine.

Further, the toner treating compound used in the method, has an advantage as follows. Namely, the toner treating compound is a liquid including a component of resin and it is superior in compatibility to the resin of the color toner and provides adhesiveness as its own characteristics. Therefore, it may easily transfer the color image to an object by coating the toner treating compound to the color image and the transferred image surface has a good durability after transfer since the image includes such a resin component.

Furtheremore, the present invention has an advantage that the color image treated by the toner treating compound is very flexible, and therefore it becomes possible to smoothly transfer the image onto not only a plane surface but also a curved surface of convex and concave. This means that it is possible to carry out a transfer of a color copy to any article of many kinds of shape.

Other functions and advantages of the present invention will be apparent from the description of the embodiments according to the following figures.

BRIEF DESCRIPTION OF THE DRAWINGS

The drawings show embodiments of a method of transferring a color copy according to the present invention in which.

DETAILED DESCRIPTION OF THE PREFERRED EMBODIMENTS

The method of transferring a color copy and a toner treating compound used for the method as the first embodiment, will be described in detail with reference to FIGS. 1 through 5, as follows.

Figure 1:
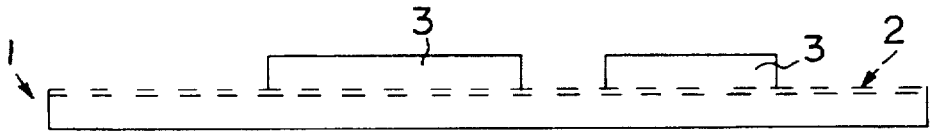
FIG. 1 is a sectional view showing a process of the method of transfer in the first embodiment.

The color copy machine used in the first embodiment is a color toner type which is on the market. FIG. 1 is a sectional view showing a state that a desired original image is copied by inserting a separable sheet 1 into the color copy machine.

The material of the separable sheet 1 used in this invention is made of a plastic film which is relatively superior in heat resistance, and a separable layer of silicone is provided on a side thereof. However, this kind of the separable sheet 1 belongs to a conventional art and is ordinary on the market.

The separable sheet 1 may be made of ordinary paper instead of plastic film.

Four types are prepared as the toner treating compound used in this embodiment.

The first toner treating compound consists of the following contents.

| | |
|---|---|
| A. As a solvent: | |
| (1) Toluene | 40% (weight ratio) |
| (2) Ethyl acetate | 15% |
| (3) Isopropyl alcohol | 20% |
| B. As a solid content: | |
| (1) Epoxy resin | 7% |
| (2) Butyrated resin | 13% |
| (3) Cellulose nitrate resin | 5% |

As the ratio of the solvent, in connection with toluene and ethyl acetate, there is no problem in increasing or decreasing their amounts in a range of ±15%, considering its function. Further, as the ratio of the solid content, there is no problem in using epoxy resin or butyrated resin independently in view of its function and also in increasing or decreasing its amount in a range of ±10%.

The second toner treating compound consists of the following contents.

| | |
|---|---|
| A. As a solvent: | |
| (1) Toluene | 42% (weight ratio) |
| (2) Methyl-ethyl-ketone | 15% |
| (3) Isopropyl alcohol | 15% |
| B. As a solid content: | |
| (1) Urethane resin | 28% |

As the ratio of the solvent, in connection with toluene and methyl-ethyl-ketone, there is no problem in increasing or decreasing their amounts in a range of ±15%, considering its function, as mentioned in the first toner treating compound. Further, as the ratio of the solid content, there is no problem in increasing or decreasing its amount in a range of ±10%, considering its function.

The third toner treating compound consists of the following contents.

| | |
|---|---|
| A. As a solvent: | |
| (1) Isopropyl alcohol | 55.4% (weight ratio) |
| (2) Cyclohexane | 33.8% |
| (3) n-hexane | 6.2% |
| (4) Toluene | 4.6% |
| B. As a solid content: | |
| (1) Polyamide resin | 100% |

As the ratio of the solvent, in connection with isopropyl alcohol and toluene, there is no problem in increasing or decreasing their amounts in a range of ±15%, considering its function. Further, as the ratio of the solid content, there is no problem in connection with polyamide resin in increasing or decreasing its amount in a range of ±10%.

The fourth toner treating compound consists of the following contents.

| | |
|---|---|
| A. As a solvent: | |
| (1) Isopropyl alcohol | 54.7% (weight ratio) |
| (2) Ethyl acetate | 8.6% |
| (3) Hethyl-ethyl-ketone | 12.0% |
| (4) Toluene | 24.7% |

-continued

| | |
|---|---|
| B. As a solid content: | |
| (1) Polyamide resin | 95.0% |
| (2) Cellulose acetate | 5.0% |

(Non-evaporated content 24% in weight ratio)

As the ratio of the solvent, in connection with isopropyl alcohol, toluene and methyl-ethyl-keton, there is no problem in increasing or decreasing their amounts in a range of ±15%, considering its function. Further, as the ratio of the solid content, there is no problem in connection with polyamide resin and cellulose acetate in increasing or decreasing its amount in a range of ±10%.

The silicone removing agent used in this embodiment consists of a solvent of 89.2% (weight ratio) which includes mineral oil (petroleum solvent) of 80%, propyleneglycol and butylether of 20%, and alkyl-benzene-sulfonic acid soda (anionic surface active agent) of 10.8%. The method of transferring a color copy according to this invention is carried out according to the following steps, as shown in FIGS. 1 through 5.

As shown in FIG. 1, a desired original image is copied on a separable sheet 1 by a color copy machine of toner type (not shown).

Figure 2:
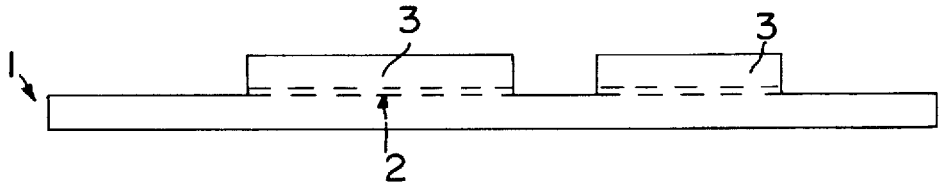
FIG. 2 is a sectional view showing another process of the method of transfer in the first embodiment.

Next, as shown in FIG. 2, the surface of a silicon layer 2 of the separable sheet 1 on which a color toner image 3 is copied, is wiped with a silicone removing agent. It is preferable to absorb the silicone removing agent with a sponge and rub the surface by the sponge. At the time, the toner image 3 is not removed, but only the remaining parts of the silicone layer 2 on the separable sheet 1, which are not covered with the toner image 3, are removed.

Figure 3:
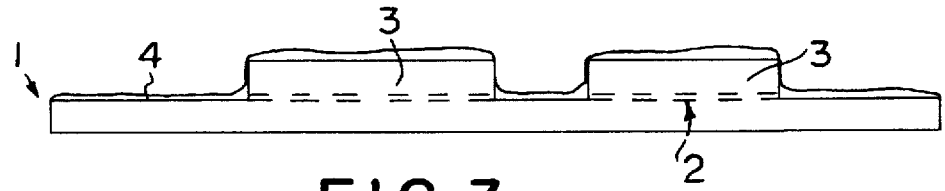
FIG. 3 is a sectional view showing another process of the method of transfer in the first embodiment.

Next, as shown in FIG. 3, the above-mentioned first toner treating compound 4 is coated on the whole surface of the separable sheet 1 including the surface of the color toner image 3. Since the toner treating compound is a liquid having volatility and viscosity, it may be stored in a small and handy container so that the liquid may be pushed out onto the separable sheet 1 with pressure to the container. Then, the toner treating compound on the separable sheet 1 is thinned by means of an ordinary bar which is used as one of the parts of transfer systems in the design industry.

Figure 4:
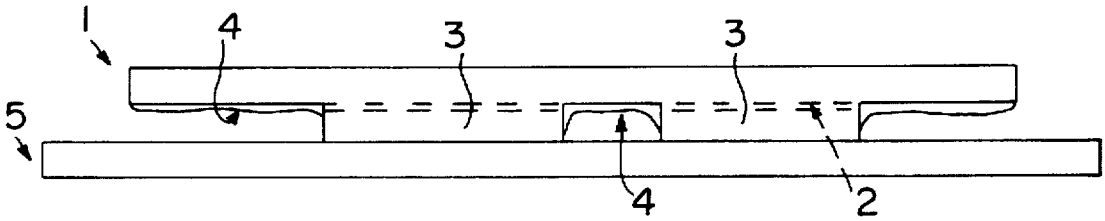
FIG. 4 is a sectional view showing another process of the method of transfer in the first embodiment.

Thereafter, as shown in FIG. 4, a transferable sheet 5 as an object for copy transfer meets the surface of the color toner image 3 of the separable sheet 1, and the reverse surface of the separable sheet 1 is rubbed by means of a pallet.

Figure 5:
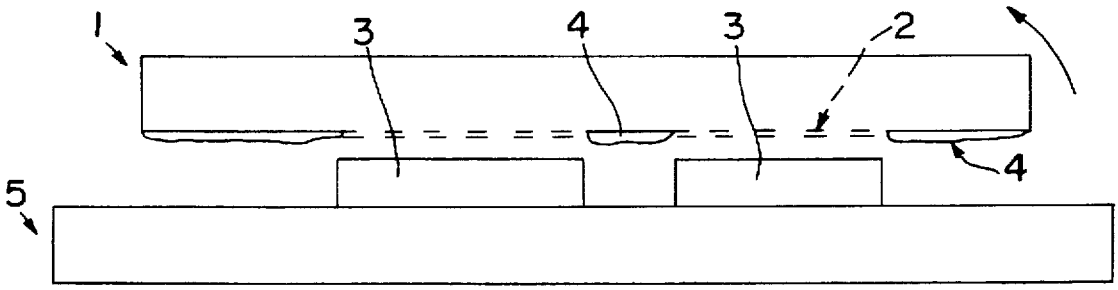
FIG. 5 is a sectional view showing another process of the method of transfer in the first embodiment.

As the result, the transferable sheet 5 is adhered to the color toner image 3 by the adhesiveness of the toner treating compound 4, and then the separable sheet 1 is peeled off the tone image 3, as shown in FIG. 5, so that the color toner image 3 may be easily separated from the separable sheet 1 because of the silicone layer 2 which is left beneath the color toner image 3. Thus, transfer of the color toner image 3 to the transferable sheet 5 is completed.

In this embodiment of the present invention, instead of the transferable sheet 5 as an object, where transfer is carried out for the surface of, for example, a solid body (commercial goods) and needs relatively a strong adhesive force for transfer, it is preferable that a strong adhesive agent may be coated on the toner treating compound. Then, the separable sheet 1 is attached to the object (commercial goods) and pressed for transfer.

In this embodiment, where the above-mentioned second toner treating compound is used, fixing the color toner to the separable sheet 1 is substantially the same as the first toner treating compound, and it is, of course, to prevent partial peeling of the color toner image 3 from the transferable sheet 5 at the time of transfer and it was found that the second toner treating compound is suitable for transfer to a solid body having a curved surface such as a base and the like which have characters in shape, since the transferred toner image 3 is in a state of film which is superior in flexibility.

Next, the second embodiment of the present invention will be described in detail with reference to FIGS. 6 through 11.

A preferred embodiment of the method of transferring a color copy, a toner treating compound and a transfer sheet for a color copy acording to the present invention will be described in detail as follows.

First, the toner treating compound used for tranferring a color copy comprises a toner treating component A and a toner treating component B, and prepared as follows.

The toner treating component A:

The toner treating component A is prepared by a solvent including toluene of 42%, methyl-ketone of 15%, isopropyl alcohol of 15%, and a solid content including urethane resin of 28%.

The toner treating component B:

The toner treating component B is prepared by a solvent including toluene of 40%, ethyl acetate of 15%, isopropyl alcohol of 20%, and a solid content including epoxy resin of 7%, butyrated resin of 13% and cellulose acetate of 5%.

As the acceptable range of preparation, in connection with toluene of 42%, methyl-ketone of 15% and isopropyl alcohol of 15% as the toner treating component A, they may be prepared within a range of ±5%. Urethane resin of 28% may be prepared within a range of ±3%.

As the acceptable range of mixing of the toner treating component B, toluene of 40%, ethyl acetate of 15% and isopropyl alcohol of 25%, may be prepared within a range of ±5%. Epoxy resin of 7%, buthyrated resin of 13% and cellulose acetate of 5% may be prepared within a range of ±3%.

The toner treating compound:

The toner treating compound is prepared by mixing the toner treating component A of 20%~40% and the toner treating component B of 60%~80%.

According to the object for transfer, the toner treating compound, which is prepared by mixing the toner treating component A and the toner treating component B at a predetermined ratio, may be diluted with toluene within a range of 1~100% (double) and used.

Next is the description of an ultraviolet ray absorbing agent as an additive.

As the ultraviolet ray absorbing agent, it is mixed in a ratio of 1%. It is possible to set its acceptable range within 0.5%~5%. This embodiment uses an ultraviolet ray absorbing agent of benzophenone (Trade name: VIOSORB 130). It is possible to use an ultraviolet ray absorbing agent of benzotriazole, but in any case, they are on the market.

Next is the detailed description of the separable sheet.

As the separable sheet for copy, it is sufficient that the separable sheet may be inserted into a color copy machine, and in this embodiment, an ordinary paper (a machine made paper) with a silicone treatment is used. However, it is, of course, possible to use a plastic film which is used in the field of this industry.

Next is the detailed description of the base sheet of the transfer sheet.

As the base sheet, a translucent (or semi-translucent) plastic film with a silicone layer thereon is used in order to easily carry out transfer operations. This kind of the separable sheet per se is well known.

Next, the method of transferring a color copy according to the present invention will be described with reference to FIGS. 6 through 11. In this embodiment, a desired color image 102, namely a full color letter (output by a personal computor), is copied on a separable sheet 101 by means of a color copy machine and then the color image will be transferred onto an object, namely a paper here.

Figure 6:
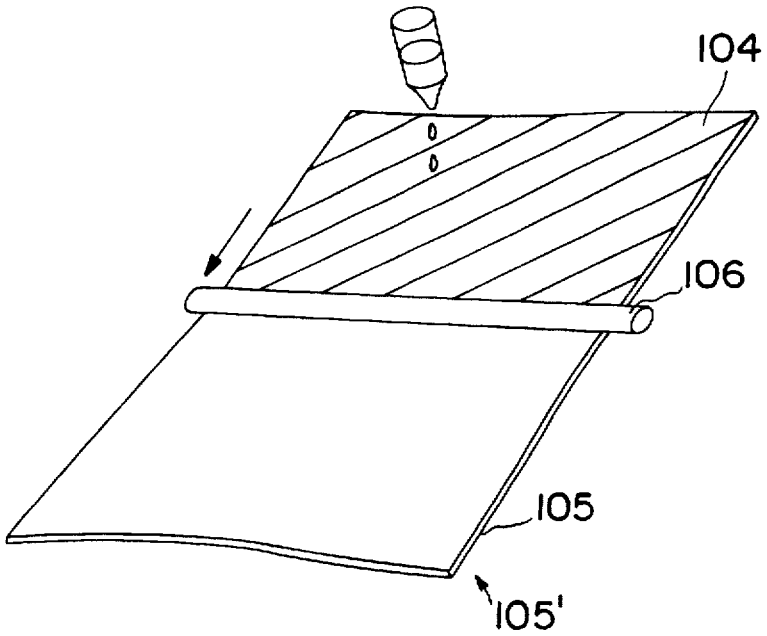
FIG. 6 is a perspective view showing a first step of the method of transfer in the second embodiment.

FIG. 6 shows a state of an initial coating step that the toner treating compound 104 is coated thin on a base sheet 105 having separable treatment, and then dried. Coating of the toner treating compound is carried out in such a manner that the toner treating compound 104 stored in a flexible container is squeezed above the base sheet 105 and then thinned by means of a bar 106 which is ordinarily used in this kind of operation. Drying is usually carried out by means of a dryer.

One obtained by completion of these processes is a transfer sheet 105' according to this invention.

Figure 7:
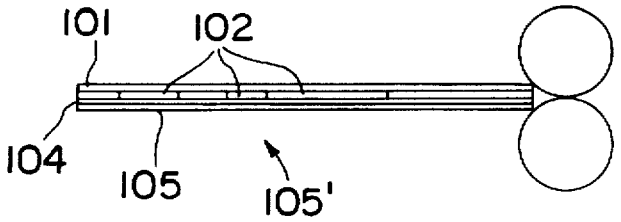
FIG. 7 is a sectional side view showing a second step of the method of transfer in the second embodiment.

Next, as shown in FIG. 7, the color image 102 copied on the separable sheet 101 meets the layer of the toner treating compound 104 and these are inserted through heat rollers (having function of thermo regulation) in such a state that the base sheet 105 and the separable sheet 101 overlap each other. The heat rollers comprise a pair of rollers which are electrically heated and positioned closely face to one another. This type is ordinarily on the market, and constructed to adjust temperature and pressure. In this case, it is preferable to set the heated temperature at around 80° C. Therefore, it may be understood that an iron may be used instead of the heat rollers.

Figure 8:
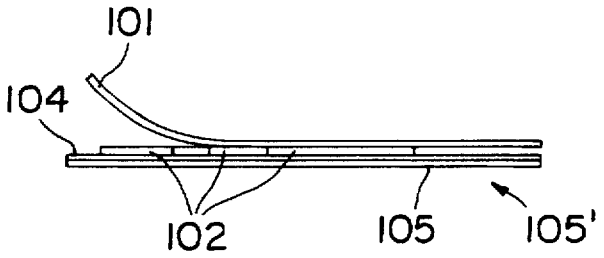
FIG. 8 is a sectional side view showing a third step of the method of transfer in the second embodiment.

Then, as shown in FIG. 8, the separable sheet 101 is peeled off from the base sheet 105 and the color image 102 is transferred to the base sheet 105.

Figure 9:
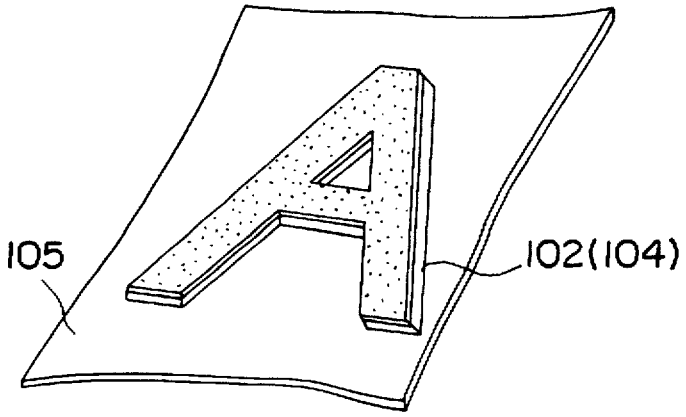
FIG. 9 is a perspective view showing a fourth step of the method of transfer in the second embodiment.

Next, as shown in FIG. 9, the base sheet 105 is wiped with a solvent of alcohol, so as to dissolve and remove the toner treating compound 104 except covered by the color image 102. The alcohol solvent is used by absorbing the same with a sponge or a cotton.

Figure 10:
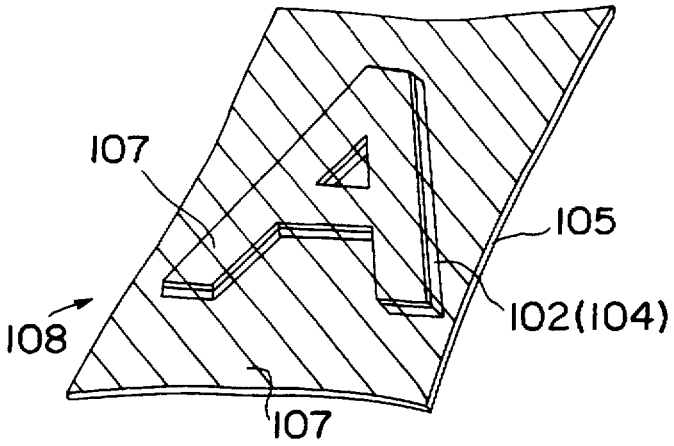
FIG. 10 is a perspective view showing a fifth step of the method of transfer in the second embodiment.

Thereafter, as shown in FIG. 10, a pressure sensitive adhesive 107 is coated on the base sheet 105. As the pressure-sensitive adhesive, it is sufficient to use an ordinary one which is liquid or fluid and it is possible that its coating manner may be substantially the same as the above-mentioned toner treating compound 104.

With completion of these processes, a transfer sheet 108 of the present invention is obtained. Namely, the transfer sheet 108 according to the present invention is one which went through all of the above-mentioned processes.

Figure 11:
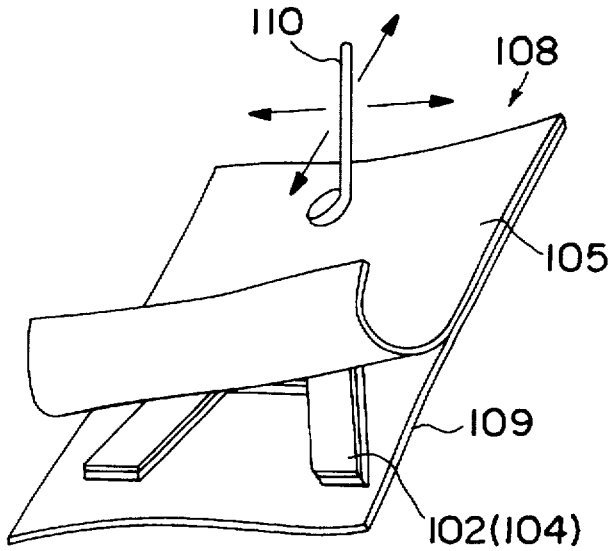
FIG. 11 is a perspective view showing a sixth step of the method of transfer in the second embodiment.

Thereafter, the transfer sheet 108 of the invention, as shown in FIG. 11 is overlapped onto a paper 109 and pressed by means of a pallet 110, so as to finish the transfer by peeling off the transfer sheet 108 from the paper 109.

The foregoing relates to preferred exemplary embodiments of the invention, it being understood that other variants and embodiments thereof are possible within the spirit and scope of the invention, the latter being defined by the appended claims.

What is claimed is:

1. A method of transferring a color copy comprising the steps of:

copying a desired image, by means of a color copy machine, onto a separable sheet having a separable layer of silicone, removing the parts of the silicone layer on the separable sheet which are not covered by the image, coating a toner treating compound onto the whole surface of the separable sheet including the image, said toner treating compound being prepared from at least a solvent consisting of at least toluene and ethyl acetate and a solid content consisting of at least epoxy resin or butyrated resin, and transferring by fitting the imaged surface of the separable sheet to an object and pressing a reverse surface of the separable sheet to carry out the transfer.

2. A method as claimed in claim 1, further comprising the step of:

prior to coating with the toner treating compound, cleaning the whole surface of the separable sheet with a silicone removing agent prepared by a solvent of petroleum and a surface-active agent so as to remove the parts of the silicone left on the separable sheet which are not covered by the image.

3. A method of transferring a color copy comprising the steps of:

copying a desired image, by means of a color copy machine, onto a separable sheet having a separable layer of silicone, removing the parts of the silicone layer on the separable sheet which are not covered by the image;

coating a toner treating compound onto the whole surface of the separable sheet including the image, said toner treating compound being prepared from at least a solvent consisting of at least toluene and methyl-ethyl-ketone and a solid content consisting of at least urethan resin, and transferring by fitting the imaged surface of the separable sheet to an object and pressing a reverse surface of the separable sheet to carry out the transfer.

4. The method as claimed in claim 3, further comprising the step of:

prior to coating with the toner treating compound, cleaning the whole surface of the separable sheet with a silicone removing agent prepared by a solvent of petroleum and a surface-active agent so as to remove the parts of the silicone left on the separable sheet which are not covered by the image.

5. A method of transferring a color copy comprising the steps of:

copying a desired image, by means of a color copy machine, onto a separable sheet having a separable layer of silicone, removing the parts of the silicone layer on the separable sheet which are not covered by the image;

coating a toner treating compound onto the whole surface of the separable sheet including the image, said toner treating compound being prepared from at least a solvent consisting of at least isopropyl alcohol and toluene and a solid content consisting of at least polyamide resin, and transferring by fitting the imaged surface of the separable sheet to an object and pressing a reverse surface of the separable sheet to carry out the transfer.

6. A method as claimed in claim 5, further comprising the step of:

prior to coating with the toner treating compound, cleaning the whole surface of the separable sheet with a silicone removing agent prepared from a solvent of petroleum and a surface-active agent so as to remove the parts of the silicone left on the separable sheet which are not covered by the image.

* * * * *